US008744334B2

(12) United States Patent
Ferrar et al.

(10) Patent No.: US 8,744,334 B2
(45) Date of Patent: Jun. 3, 2014

(54) ELECTROSTATOGRAPHIC APPARATUS HAVING IMPROVED TRANSPORT MEMBER

(75) Inventors: Wayne T. Ferrar, Fairport, NY (US); Donald S. Rimai, Webster, NY (US); Edward T. Miskinis, Rochester, NY (US); Douglas E. Garman, Webster, NY (US); Mark C. Zaretsky, Rochester, NY (US); Patrick M. Lambert, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 859 days.

(21) Appl. No.: 12/609,027

(22) Filed: Oct. 30, 2009

(65) Prior Publication Data

US 2011/0103860 A1 May 5, 2011

(51) Int. Cl.
*G03G 15/00* (2006.01)

(52) U.S. Cl.
USPC ..... 399/400

(58) Field of Classification Search
None
See application file for complete search history.

(56) References Cited

U.S. PATENT DOCUMENTS

| | | | | |
|---|---|---|---|---|
| 4,780,356 | A | | 10/1988 | Otouma et al. |
| 4,879,166 | A | | 11/1989 | Misuda et al. |
| 5,085,698 | A | | 2/1992 | Ma et al. |
| 5,157,445 | A | | 10/1992 | Shoji et al. |
| 5,406,364 | A | | 4/1995 | Maeyama et al. |
| 5,480,724 | A | * | 1/1996 | Fitzgerald et al. ..... 428/447 |
| 5,512,409 | A | | 4/1996 | Henry et al. |
| 5,605,750 | A | | 2/1997 | Romano et al. |
| 5,693,442 | A | | 12/1997 | Weiss et al. |
| 5,723,211 | A | | 3/1998 | Romano et al. |
| 5,903,802 | A | | 5/1999 | Watanabe et al. |
| 6,075,965 | A | | 6/2000 | Tombs et al. |
| 6,184,911 | B1 | | 2/2001 | Tombs |
| 7,068,959 | B2 | | 6/2006 | Allen et al. |
| 7,120,380 | B2 | | 10/2006 | Ferrar et al. |
| 7,252,873 | B2 | | 8/2007 | Ferrar et al. |
| 2006/0160002 | A1 | * | 7/2006 | Qi et al. ..... 430/58.2 |
| 2006/0165974 | A1 | * | 7/2006 | Ferrar et al. ..... 428/335 |
| 2007/0196151 | A1 | | 8/2007 | Ferrar et al. |
| 2008/0107463 | A1 | | 5/2008 | Ferrar et al. |
| 2009/0052964 | A1 | | 2/2009 | Ferrar et al. |

* cited by examiner

*Primary Examiner* — Joshua D Zimmerman
(74) *Attorney, Agent, or Firm* — Andrew J. Anderson; Raymond L. Owens

(57) ABSTRACT

The present invention is an electrostatographic reproduction apparatus which includes a primary imaging member for producing an electrostatic latent image, a development station for applying toner particles to said latent image which forms a developed toner image, and a transfer station for transferring said developed toner image from the primary imaging member to a receiver. A fuser assembly is included for fixing the developed toner image to the receiver, to form a fused toner image on the receiver. An endless transport member is provided for transporting the receiver to or from the fuser assembly, the transport member having a substrate bearing an oil-absorbing porous layer that would tribocharge positively upon contact with negatively charged toner particles, and a porous overcoat outermost layer that does not tribocharge positively upon contact with negatively charged toner particles.

16 Claims, 1 Drawing Sheet

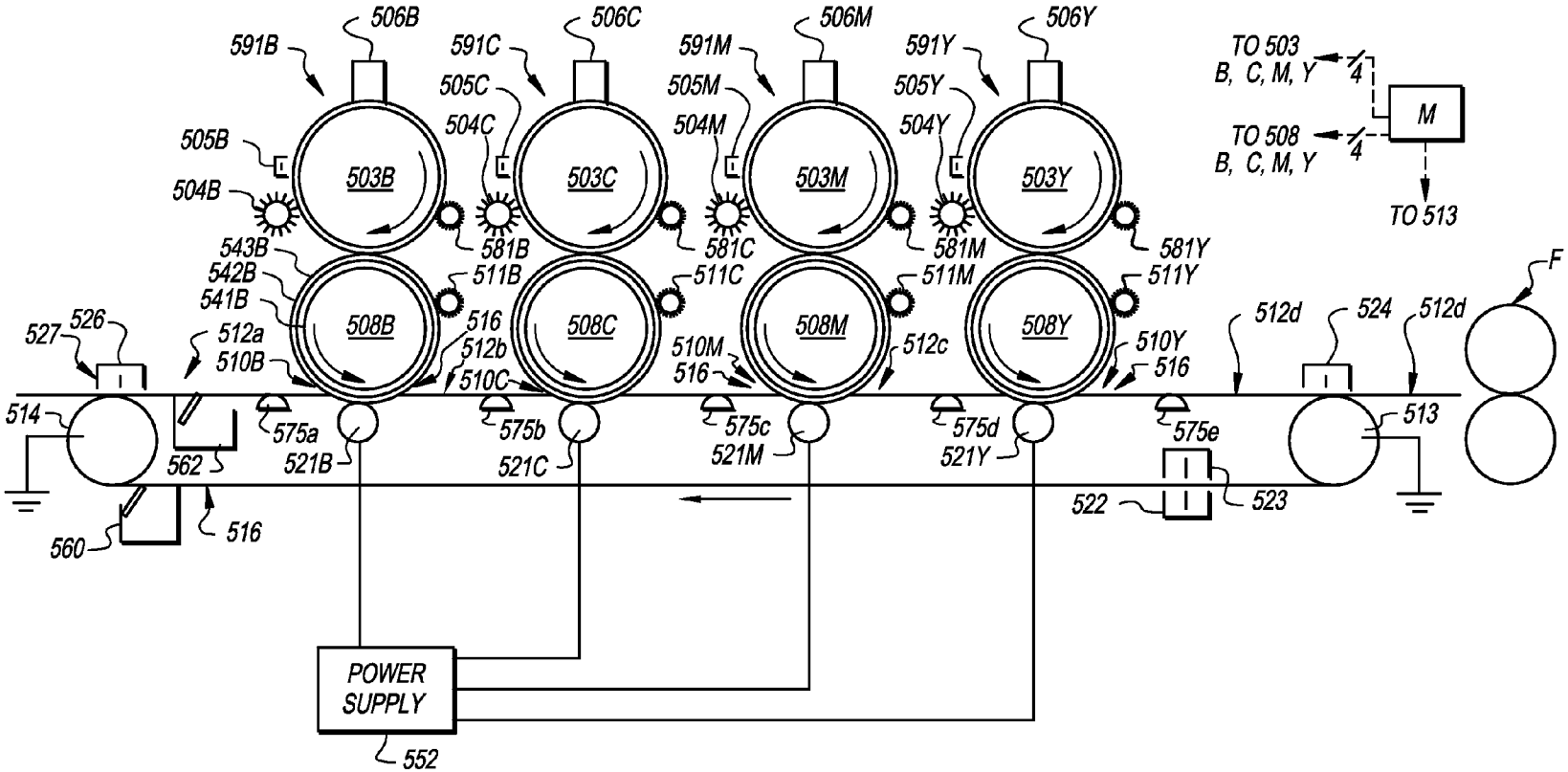
F
M
TO 513
TO 503
B, C, M, Y
TO 508
B, C, M, Y
4
4
512d
513
524
512d
523
575e
522
581Y
511Y
510Y
516
506Y
503Y
508Y
575d
521Y
591Y
505Y
504Y
581M
511M
512c
506M
503M
508M
575c
521M
591M
505M
504M
581C
511C
510M
516
506C
503C
508C
575b
521C
591C
505C
504C
581B
511B
516
512b
510C
506B
503B
508B
575a
521B
591B
505B
504B
543B
542B
541B
512a
510B
562
516
526
527
514
560
POWER SUPPLY
552

ELECTROSTATOGRAPHIC APPARATUS HAVING IMPROVED TRANSPORT MEMBER

FIELD OF THE INVENTION

The present invention relates to electrostatographic image reproduction and, more particularly, to an electrostatographic apparatus that includes a transport web provided with a release oil-absorbing layer.

BACKGROUND OF THE INVENTION

Electrostatographic printers produce images by transferring polymeric toner particles from a photoreceptor to a receiver and fixing the toner particles to the receiver with heat and pressure. Various additives and oils are used to aid the transfer of the particles. Silicone oil is commonly used as a release oil because it is thermally stable and incompatible with the toner particles and other polymers in the printer; unfortunately, however, it tends to spread throughout the machine as prints are made. Release oil spread is exacerbated by duplex printing, which entails the application of images to both sides of a receiver sheet. Oil provided to the receiver during application of the first image on one side of a receiver is carried into the printer on the paper transport web in the course of applying the second image to the opposite side, leading to objectionable image artifacts such as non-uniform density and differences in gloss. Details of fuser oil application are given in U.S. Pat. Nos. 5,157,445 and 5,512,409, the disclosures of which are incorporated herein by reference.

Ink-jet printers produce images by ejecting droplets of ink onto receivers that absorb ink. Porous coatings of inorganic particles on the receivers improve the image quality by, for example, causing more rapid drying of the ink, reducing image spread, and producing more uniform ink coverage. Silica and alumina particles incorporated into binder polymers are used for coatings on paper and coatings on clear plastics such as polyethylene terephthalate sheets. While larger particles can be used to produce opaque coatings on paper substrates, smaller particles are required for coatings that are transparent in a binder, which is also desirably transparent and colorless. Microporous ink-jet recording elements prepared using psuedo-boehmite in organic polymer matrices are described in, for example, U.S. Pat. Nos. 5,723,211; 5,605,750; 5,085,698; 4,879,166; and 4,780,356, the disclosures of which are incorporated herein by reference.

Similar materials have also been used in electrophotography. U.S. Pat. No. 5,406,364 to Maeyama et al. describes a cleaner in the form of a web prepared by immersing a piece of non-woven fabric into a colloidal solution of alumina or silica sol. Poly(vinyl alcohol) may also be added. The patent teaches that porous particles can absorb release agent to clean contaminated surfaces in an electrophotographic apparatus. There is no mention of transparency, or reference to the size of the oxide particles. The web is used to remove silicone oil from the transfer drum. The coating is not subjected to repeated charging and discharging in the electrophotographic process and thus it does not have to possess insulating properties. Furthermore the material itself is not cleaned of toner from the electrophotographic process and, therefore, does not have to possess a low surface energy.

U.S. Pat. No. 5,903,802 to Watanabe et al. uses pseudo-boehmite particles as well as silica particles, porous ceramics and foamed metals to clean transfer members and photoreceptors. Release agent absorbing layers are placed in various parts of the electrophotographic apparatus such as the feed passage member. Particle size is not important because there is no requirement for the layer to be transparent, nor is the coating subjected to repeated charging and discharging in the electrophotographic process. Furthermore the material itself is not cleaned of toner from the electrophotographic process and therefore does not have to possess a low surface energy.

Pseudo-boehmite coatings have also been applied to the photoreceptors used in electrophotographic printing. U.S. Pat. No. 5,693,442, the disclosure of which is incorporated herein by reference, describes the incorporation of a nickel metallized dye into an overcoat of pseudo-boehmite to act as a filter to protect the light sensitive element. The inorganic particles and 5 wt. % of the metallized dye in a poly(vinylpyrrolidone) binder form a transparent layer that can be charged under a corona charger and discharged by exposure to actinide radiation.

Pseudo-boehmite is disclosed as an oil absorbing layer that employs fluorinated surfactants as cleaning aids in U.S. Pat. No. 7,120,380. Pseudo-boehmite is disclosed as in a transport member for an electrophotographic apparatus that displays high friction in U.S. Pat. No. 7,252,873. Pseudo-boehmite is disclosed as an oil absorbing layer that employs wax overcoats as cleaning aids in US 2007/0196151. Gamma-alumina is disclosed as an oil absorbing layer that employs siloxanes surfactants as cleaning aids in US 2008/0107463. Gamma-alumina is disclosed as an oil absorbing layer that employs fluoro surfactants as cleaning aids in US 2009/0052964. All five of these applications are incorporated by reference into this application.

The mitigation of objectionable image artifacts such as non-uniform density and differences in gloss that result from the spread of release oil from an imaged receiver into the reproduction apparatus, particularly during a duplex printing process, is provided by the present invention.

SUMMARY OF THE INVENTION

The present invention is an electrostatographic reproduction apparatus which includes a primary imaging member for producing an electrostatic latent image, a development station for applying toner particles to said latent image which forms a developed toner image, and a transfer station for transferring said developed toner image from the primary imaging member to a receiver. A fuser assembly is included for fixing the developed toner image to the receiver, to form a fused toner image on the receiver. An endless transport member is provided for transporting the receiver to or from the fuser assembly, the transport member having a substrate bearing an oil-absorbing porous layer that would tribocharge positively upon contact with negatively charged toner particles, and a porous overcoat outermost layer that does not tribocharge positively upon contact with negatively charged toner particles. The oil-absorbing porous layer may include alumina inorganic particles of siloxane coated gamma-alumina, dispersed in an organic binder, and the porous overcoat may contain silica particles in a binder. The transport member with the silica particles will charge negative against negative charging toner particle. The transport member may also contain a fluorosurfactant.

BRIEF DESCRIPTION OF THE DRAWINGS

FIG. 1 is a schematic side elevational view of an electrostatographic reproduction apparatus that includes an endless web transport member for moving a receiver to and from a fuser assembly.

For a better understanding of the present invention together with other advantages and capabilities thereof, reference is made to the following description and appended claims in connection with the preceding drawings.

DETAILED DESCRIPTION OF THE INVENTION

FIG. 1 shows an exemplary image-forming electrostatographic reproduction apparatus, with black (B), cyan (C), magenta (M) and yellow (Y) electrophotographic modules designated generally by 591B, C, M and Y, that each includes a primary image-forming member, for example, drums 503B, C, M and Y having a photoconductive surface, upon which a pigmented marking particle image is formed. To form images, the outer surface of drums 503B, C, M and Y are first cleaned by a cleaning station 504B, C, M and Y, and then uniformly charged by a primary charger such as a corona charging device 505B, C, M and Y, and the uniformly charged surface is exposed by suitable exposure device such as a laser 506B, C, M and Y to selectively alter the charge on the surface of the drum, thereby creating an electrostatic image corresponding to an image to be reproduced. The electrostatic images are developed by application of pigmented marking particles to the image bearing photoconductive drums by development stations 581B, C, M, and Y. Additional electrophotographic modules may be employed to apply additional colored marking particles, and/or clear toner particles.

The marking particle (and/or clear toner) images are transferred to the outer surface of a secondary or intermediate image transfer member, for example, intermediate transfer drums 508B, C, M and Y, that may includes a metallic conductive core 541B, C, M, and Y, a relatively thick compliant layer 542B, C, M and Y, and a relatively thin hard overcoat layer 543B, C, M and Y. With a relatively conductive intermediate image transfer member drum, transfer of the color marking particle images to the surface of the intermediate transfer member drum can be accomplished with a relatively narrow nip and a relatively modest potential.

Marking particle images respectively formed on the surfaces of the intermediate image transfer member drums are transferred to receivers 512*a, b, c*, and *d* which are fed into nips 510B, C, M and Y between the intermediate image transfer member drums and a receiver transport (and transfer backing) member 516, thus forming transfer station for transferring the developed toner image from the primary imaging member to a receiver. The receivers are fed from a suitable receiver member supply (not shown) to the transport member 516, and into the transfer nips where it receives the marking particle image. The receivers exit the final nip, and are transported to a conventional fuser assembly F, where the marking particle images are fixed to the receivers by application of heat and/or pressure. The receiver members bearing the fused images are then transported to a storage location (not shown) or is inverted by a conventional turnover device mechanism (not shown) for transfer of a second image to the reverse side of the receiver. Suitable fuser assemblies and turnover device mechanisms for use in the present invention are described, e.g., in U.S. Pat. No. 7,068,959, the disclosure of which is incorporated by reference, wherein a transport belt 26 is employed to transport receiver members with transferred toner images to a fuser assembly comprising a fuser roller 32 and a pressure roller 34, and a turnover device 40 is employed to invert a receiver member before being returned to the transfer belt.

Transport member 516 is entrained about a plurality of support members, for example rollers 513 and 514 and 521B, C, M and Y. Support rollers 521B, C, M and Y are electrically biased by power supply 552 to a level sufficient to efficiently urge transfer of marking particle images from the intermediate image transfer member drums to receivers. At the same time, support roller 514 is electrically biased, for example to ground potential, to a level sufficient to eliminate ionization and premature transfer upstream of the transfer nips. The receiver members 512*a, b, c* and *d* attach to the transport member web 516 at roller 514 with the aid of corona charger 526 which charges one surface (top shown) of the receiver member so that it is electrostatically held with its other surface in contact with the web. The grounded roller 514 supplies charge to the back side of the web 516. An optional blade 527 on the charger 526 ensures good contact of the receiver sheet with the transport member web 516. Downstream of nip 510Y the receiver members detack from the transport member web 516 at roller 513 with the aid of corona charger 524 which discharges the receiver member; for example, by applying a charge that will neutralize the charge on the top surface of the receiver member. Subsequently the toner image transferred to the receiver member is fused to the receiver member by a fuser F. The transport member web is reconditioned by providing charge to both surfaces by opposed corona chargers 522, 523 which neutralize charge on the surfaces of the transport member. Both sides of the transport member web 516 can be cleaned by any appropriate cleaner such as blades 560 and 562. A motor M and suitable drive mechanisms are provided for driving the various members in the directions indicated by the respective arrows showing movement. It is known in electrophotographic engines to provide drive to one component such as a belt so that the belt can frictionally drive a drum. A cleaner 111B, C, M and Y cleans the surface of the intermediate transfer drums 508B, C, M and Y.

The apparatus shown in FIG. 1 is a full color machine where the electrophotographic modules work in parallel. Each electrophotographic module 591B, C, M, and Y produces a different color and all operate simultaneously to construct 4 color image. In this embodiment the transport member web 516 serially transports the receiver members 512*a*, 512*b*, 512*c* and 512*d* through nips 510B, C, M and Y formed by the intermediate transfer members of each module where each color is transferred in turn to a respective receiver member so that each receiver member receives up to four (or more) superposed registered color images to be formed on one side thereof. The path of the receiver member for serially receiving in transfer the various different color images is generally straight facilitating use with receiver members of different thickness. Support structures 575*a, b, c* and *d* may be provided before entrance and after exit locations of each transfer nip to engage the transport member on the backside and alter the straight line path of the transport member to provide for wrap of the transport member about each respective intermediate transfer member, which wrap allows for reduced pre-nip and post-nip ionization. Registration of the various stations application of color to the receiver member may be provided by various well known means such as by controlling timing of entry of the receiver in the nip in accordance with indicia printed on the receiver member or on a transport belt wherein sensors sense the indicia and provide signals which are used to provide control of the various elements. Alternatively, control may be provided without use of indicia using a robust system for control of the speeds and/or position of the elements. While not shown, suitable controls can be provided using programmed computers and sensors including encoders which operate with same as is well known in this art.

As is well known, to facilitate release of a fixed toner image from a fuser assembly, a release agent such as silicone oil is applied to either the imaged receivers or to the fuser assembly (e.g., a mechanism such as depicted in FIG. 1 of the previously cited U.S. Pat. No. 5,157,445). As already noted, an excess of this oil can be carried to other parts of the apparatus, especially in the course of duplex printing, resulting in objectionable image artifacts.

In accordance with the present invention, a receiver transport member in an electrostatographic reproduction apparatus, such transport member 516 as depicted in FIG. 1, includes a release oil-absorbing layer disposed on a substrate. Although the transport member is exemplified as a continuous web 516 in FIG. 1, it may take other forms such as, for example, a drum or roller. The electrostatographic reproduction apparatus further includes a primary image-forming member, which is exemplified in FIG. 1 as drums 503B, C, M and Y, but may be constructed in another form such as, for example, a roller or a belt. As depicted in FIG. 1, the reproduction apparatus optionally includes, operationally associated with the primary image-forming member, an intermediate image transfer member, which is depicted in FIG. 1 as drums 508B, C, M and Y, but may also be constructed in another form such as, for example, a roller or a belt.

While FIG. 1 depicts a transport member provided with an oil-absorbing layer in accordance with the present invention in a full color reproduction apparatus having four toner development stations for cyan, magenta, yellow, and black, the present invention is applicable to single, or less than full color reproduction apparatus. For example, the receiver transport members of the invention may be employed as the endless web transfer backing member employed in the various other embodiments of U.S. Pat. No. 6,075,965, the disclosure of which is incorporated herein by reference. As described above, a developed multicolor (or single color) image, following fixing by a fuser assembly, can be transported to a storage site or inverted and circulated back for recording an image on the opposite side of the receiver.

Charge is repeatedly applied to the surface of the transport member in every imaging cycle at each of the transfer nips. The transport web is reconditioned in each cycle by providing charge to both surfaces by opposed corona chargers 522, 523 in FIG. 8 of U.S. Pat. No. 6,075,965. An additional corona charger 524 provides negative charge of approximately 600-900 V to tack down of the paper or receiver to the transport web thus preventing the receiver from moving as it goes through the electrophotographic process. After transfer of the toner image to the receiver, the receiver is conveyed on the transport web to a nip where an electrical bias is applied so the receiver can be detacked and fed into a fuser station. Additionally the web is imaged with various colored toners that are used for process control of image density and registration. Thus, it is important that the transport member have insulating properties that allow for efficient charging and for the maintenance of the charge throughout the electrophotographic cycle. If the resistivity of the transport member decreases due to high humidity, the image quality of the process is compromised. In general poly(ethylene terephthalate) is one of the preferred substrates for the transport member because it has good insulating properties. It would be desirable that any coating on the transport member maintain similar insulating properties.

It is also desired that the layer be transparent or translucent so that sensors for process control can be used to monitor toner density and image registration. These sensors can work by passing light through the coated transport web to a detector on the opposite side or by reflecting the light back to a detector mounted above the sensor. The light may be reflected by a separate reflector after the light has passed through the web, or by the support itself.

Previous inventions for release oil absorbing layers employed pseudo-boehmite particles. Pseudo-boehmite is a xerogel of boehmite and is represented by the chemical formula Al(O)OH. It is a crystalline solid with the boehmite X-ray diffraction pattern. Pseudo-boehmite is a highly hydrated form of alumina and contains a large amount of water, which makes it a poor electrical insulator. It is easily dispersed in water from which it can be coated onto a support with poly(vinyl alcohol) as a binder.

A more condensed form of pseudo-boehmite is gamma-alumina. Gamma-alumina is a crystalline phase of aluminum oxide that can be prepared by heating pseudo-boehmite to 500-550° C. for three hours. It is used as a filler particle in silicone polymers and as a catalyst for petroleum refining and in automobile catalytic converters. In this invention we incorporate gamma-alumina into a transparent layer to absorb silicone release fluid in an electrophotographic printer where the release fluid comes from the fuser. The gamma-alumina can be dispersed in organic solvents by milling techniques and coated with binder polymers such as poly(vinyl butyral) onto various supports. These coatings have the advantage over porous layers made from using pseudo-boehmite particles because they display a higher electrical resistivity, even at high humidity. The transparent, porous coatings made with the gamma-alumina will thus hold a charge that is deposited by a corona or roller charger for a longer period of time, allowing for improved tackdown of an electrophotographic receiver and more efficient transfer of toner particles for imaging. Additionally, these porous coatings with the gamma-alumina and an organic binder can be overcoated with wax that melts below 100° C. to produce a layer that has lower surface energy for removal of toner during cleaning. We also show below that the gamma-alumina particles and coatings can be modified with poly(siloxanes) to further increase the resistivity to allow for better receiver tack down and facilitate toner removal after the charge is removed from the coating.

The gamma-alumina inorganic particles are represented by the chemical formula $Al_2O_3$. Literature reference to gamma-alumina include K. Sohlberg, S. J. Pennycook, and S. T. Pantelides, J. Am. Chem. Soc. 1999, 121, 7493-7499 and J. Temuujin, Ts Jadambaa, K. J. K. MacKenzie, P. Angerrer, F. Porte, and F. Riley, Bull. Mater. Sci, Vol. 23, No. 4, August 2000, pp 301-304. The pore characteristics of the gamma-alumina vary depending upon the size and shape of the particles. The particle size is determined by the effectiveness of breaking up the agglomerates to form the primary particle size. Calcining of a pseudo-boehmite particle at 500° C. for 3 hours forms gamma-alumina crystallites that are smaller in size but have higher pore volumes than the pseudo-boehmite precursors. Larger particles scatter light to various degrees and thus it is an advantage to use a smaller particle that also produces high porosity coatings. Comparing gamma-alumina particles, smaller particles have smaller pores than the larger particles and tend to be transparent. Smaller particles with a dispersed particle size of less than 0.5 micron are used for this invention so the porous layers are transparent or translucent. More preferably, the dispersed particle size is less than 0.3 microns. Most preferably, the dispersed particle size is about 0.25 microns.

Many variations of the gamma-alumina structure are known. The alumina may be doped with various levels of lanthanum, cerium, zirconium, titanium, tungsten, neodymium, silicon, and magnesium oxides. More than one dopant may be present in the gamma-alumina crystal. Mixed silica-alumina particles have been prepared covering all compositions of the two elements, from small amounts of silica to silica rich materials. The acidic properties of these materials is compared to zeolites in a paper by W. Daniell, U. Schubert, R. Glockler, A. Meyer, K. Noweck, and H. Knozinger, Applied Catalysis A: General 196 (2000) 247-260. One source of these particles is Sasol and they are sold by the trade name SIRAL.

Gamma-alumina is a better insulator than pseudo-boehmite. Calcining the particles from the pseudo-boehmite form to the gamma-alumina form drives off much of the water within the pseudo-boehmite structure. Psuedo-boehmite has a formula of AlO(OH), reflecting a high water content, while gamma-alumina can be more closely represented by the general alumina formula of $Al_2O_3$. High purity of the gamma-alumina is also important to achieve good resistivity of the oil absorbing layer, which can be reflected in the process used to make the pseudo-boehmite. Gamma-alumina also has higher porosity than pseudo-boehmite. Thus coatings can be thinner, using less material and causing less stress in the coating that could result in cracking and delamination. Coating made with 10 microns of gamma-alumina/poly(vinyl butyral) absorb about the same amount of silicone release fluid as 20 micron coatings of pseudo-boehmite/polyvinyl alcohol (PVA).

The electrostatic charge on the on the alumina coating can be measured relative to the toner that is used in the electrophotographic process. The toners of interest in this work are those that charge negatively against a ferrite core. These toners are preferably polyesters, such as those which have been described, e.g., in U.S. Pat. Nos. 6,358,656 and 6,716,560. The toners employ a surface treatment of silica. These and other oxide treatments, including alumina, are described in Evonik Industries (formerly Degussa) Technical Information 1222 AEROSIL Fumed Silica and AEROXIDE Fumed Metal Oxides for Toner available at www.aersoil.com. The tribocharge of a toner particle or of a coating made using gamma-alumina is related to the properties of a material and the additives to the material such as a surface coating. Specifically AEROSIL RY 200 L is hydrophobic fumed silica that has been surface treated with PDMS during the manufacturing process and tribocharges negatively when shaken with other particles. AEROSIL R.972 is a hydrophobic silica due to treatment with dimethyldichlolorosilane and also tribocharges negatively. AEROSIL 130 is a hydrophilic fumed silica. The addition of aminosilanes to the AEROSIL coatings will cause the particles to tribocharge positively, and the untreated fumed alumina AEROXIDE Alu C will take on a slight positive charge. A more general discussion of tribocharging of toner against other surfaces is J. H. Anderson, Journal of Imaging Science and Technology, Volume 43, Number 5, September/October 1999.

The AEROSIL and AEROXIDE particles are made by fuming the oxide and form particles with sizes less than 50 nm. In contrast the gamma-alumina used to prepare the porous layers are converted from boehmites and media-milled to sizes of hundreds of nanometers. Another type of particle that combines silica and alumina is available from Sasol as the SIRAL oxides. These silica-alumina particles contain $SiO_2$ and $Al_2O_3$ in various combinations, where the number represents the amount of silica. Thus SIRAL-10 is $Al_2O_3$:$SiO_2$ 90:10 where the alumina is in the boehmite phase. Heating to 550° C. converts the alumina in the gamma phase.

An organic binder is employed in the oil-absorbing layer to impart mechanical strength to it. The pore characteristics and transparency of the oil-absorbing layer depend on the particular binder employed. Suitable binders include organic materials such as, for example, starch or one of its modified products, poly(vinyl alcohol) or one of its modified products, cellulose derivatives, ether-substituted poly(phosphazenes), ether-substituted acrylates, ethylene oxide-vinyl alcohol copolymers, poly(vinyl butyral) (PVB), poly(vinyl formal), polyoxazolines, aliphatic polyamides, and poly(vinylpyrrolidone). A major factor in the choice of the binder is that it is compatible with porous alumina particles and results in a transparent or translucent layer. The binder, preferably poly (vinyl butyral), is present in an amount, based on the amount of inorganic particles, of preferably about 3 wt. % to about 30 wt. %, more preferably, about 5 wt. % to about 25 wt. %. If the amount of binder is less than about 3 wt. %, the strength of the oil-absorbing layer tends to be inadequate. On the other hand, if it exceeds 30 wt. %, its porosity tends to be inadequate. Coatings made of the dispersed gamma-alumina of less than 0.5 micron dispersed particle size on transparent substrates are clear to translucent, and therefore allow for the process control sensors to operate effectively. Poly(vinyl butyral) has fewer hydroxyl groups on the polymer than poly(vinyl alcohol) because they have been substituted with a butyl group, making the polymer less polar. In general, poly(vinyl butyral)s are soluble in alcohol and organic solvents but are insoluble in water.

The negatively charging overcoat must be porous to allow the release oil to diffuse into the gamma-alumina layer, and thus prevent the formation of the image artifacts in the prints. The ratio of particles to binder in the overcoat is generally high, in much the same way as for the porous gamma-alumina layer. The binder is present in an amount, based on the amount of inorganic particles, of preferably about 3 wt. % to about 30 wt. %, more preferably, about 5 wt. % to about 25 wt. %, and most preferably from 6 to 12 wt %. Although all of the polymeric binders which are useful for the gamma-alumina porous layer may be employed, the preferred binder is poly (vinyl butyral) as it is more hydrophobic than many of the others.

The coatings prepared with gamma-alumina are inherently more insulting than those made with pseudo-boehmite. As discussed above, the gamma-alumina particles are inherently more resistive than the pseudo-boehmite particles. Correspondingly gamma-alumina sols are prepared by milling in organic solvents such as ethanol or 1-methyl-2-propanone, but unlike pseudo-boehmite they are not water dispersible. Poly(vinyl butyrals) are soluble in organic solvents and we have found that these binders generally stabilize the gamma-alumina sols in ethanol or 3A alcohol to allow for transparent coatings. The coatings have resistivities approaching $10^{12}$ ohm/sq at 70° F./60% RH, which is approximately 2 orders of magnitude more resistive than similar coatings made with pseudo-boehmite and poly(vinyl alcohol) coated from water. It is preferable to have coated transport webs made with gamma-alumina and poly(vinyl butyral) that have resistivities with a minimum surface resistivity equal to or greater than $1\times10^{11}$ ohm/sq at 70° F./60% RH.

The fumed silica particles that are used to form the negatively tribo-charging overcoat against the negatively charging toner are preferably coated with PDMS type coating to make them hydrophobic. They are less affected by humidity and maintain high resistivity even in high relative humidity (RH) environments. The fumed silicas are pure silicon oxides and unlike the boehmites and to a lesser extent the gamma-alumina do not contain water or hydroxyl units within the lattice structure of atoms. It is not desirable to treat the fumed oxide particles with the low molecular weight siloxanes if the oxides have been surface treated during the manufacturing process.

The release oil-absorbing layer preferably has a dried thickness of about 1 μm to about 40 μm, more preferably, about 2 μm to about 30 μm, and most preferably between 4 and 20 μm. The release oil absorbing layers of gamma-alumina/PVB are more efficient than the pseudo-boehmite/PVA layers of the previous work, allowing for thinner layers to absorb the same amount of oil. This is possible because of a significant improvement in the oil absorption capacity when compared to pseudo-boehmite/PVA layers. Optionally, the oil-absorbing layer can also incorporate various known additives, including surfactants, pH controllers, anti-foaming agents, lubricants, preservatives, viscosity modifiers, waterproofing agents, dispersing agents, UV absorbing agents, mildew-proofing agents, mordants, crosslinking agents such as boric acid or borax, and the like, with the proviso that the additive does not greatly decrease resistivity or the transparency of the layer. The oil-absorbing layer can also include matting agents such as matte beads comprising crosslinked polystyrene, crosslinked polyacrylate, or polytetrafluoroethylene (TEFLON) and having a diameter preferably between about 1 μm and about 30 μm, more preferably between about 2 μm and about 10 μm.

The overcoat for the release oil layer of the present invention is typically much thinner than the release oil absorbing layer. The overcoat preferably has a dried thickness of about 0.25 μm to about 10 μm, and preferably about 1 μm to about 5 μm. The layer needs only to be thick enough to cause the surface of the oil absorbing layer to charge negatively against the toner. Because the layer has a high oxide level in a polymeric binder the wear of the coating tends to be minimal.

A web substrate for the oil-absorbing layer can be reflective, translucent, or transparent and can have a thickness of, preferably about 50 μm to about 500 μm, more preferably, about 75 μm to about 300 μm. The web substrate must either allow light to pass through or be reflective. Poly(ethylene terephthalate) (PET) is a preferred substrate. Other clear semi-crystalline substrates such as poly(ethylene naphthalate) (PEN) are also thought to be useful. Antioxidants, antistatic agents, plasticizers, and other known additives may be optionally incorporated in the web substrate.

The adhesion of the oil-absorbing layer to the substrate can be improved by corona-discharge treatment of the substrate surface prior to application of the oil-absorbing layer. Alternatively, an undercoating or subbing layer formed from a halogenated phenol or a partially hydrolyzed vinyl chloride-vinyl acetate copolymer and having a thickness (i.e. a dry coat thickness) preferably of less than 2 μm can be applied to the surface of the substrate.

Optionally, an additional backing layer or coating may be applied to the backside of the web substrate, i.e., the side of the substrate opposite the side bearing the oil-absorbing layer, to improve the machine-handling properties of the transport web and controlling the friction and resistivity thereof. Typically, the backing layer includes a binder and a filler, which can be, for example, amorphous and crystalline silicas, poly (methylmethacrylate), hollow sphere polystyrene beads, microcrystalline cellulose, zinc oxide, talc and the like. The filler included in the backing layer is generally less than 2 wt. % of the binder, and the average particle size of the filler material is in the range of 5 μm to 15 μm. Typical of the binders used in the backing layer are polymeric materials such as gelatin, chitosan, acrylates, methacrylates, polystyrenes, acrylamides, poly(vinyl alcohol), poly(vinylpyrrolidone), poly(vinyl chloride)-co-poly(vinylacetate), SBR latex, NBR latex, and cellulose derivatives.

To form the release oil-absorbing layer on a substrate, a binder is added to the inorganic particles to obtain a slurry, which is coated on the substrate using, for example, a roll coater, an air knife coater, a blade coater, a rod coater, a bar coater, or a comma coater, and then dried. Preferred coating compositions for the oil-absorbing layer contain gamma-alumina and poly(vinyl butyral) in a weight ratio of about 3:1 to about 20:1.

The present invention also provides a method to eliminate slippage of the intermediate transfer drum against the transport web and thus provides for improved registration of a composite image. However it is not meant to limit these improvements only to these elements in an electrostatographic printer, and could include suppression of slippage between a photoreceptor drum or belt. According to one embodiment of the invention, a frictionally driven electrostatographic reproduction apparatus has a receiver member transport web element that is frictionally coupled with each module that produces a toned color separation image, preferably a dry toned image, and a fuser assembly with a fuser release agent for fixing developed toner images to form a fused toner image on a receiver member. The receiver member transport web is formed so as to include a substrate and a layer that contains inorganic particles of gamma-alumina dispersed in a polymeric binder to form a porous layer. U.S. 2007/0196151 described the inorganic particles as pseudo-boehmite, an agglomerated crystalline inorganic suboxide that takes the form of plates and needles. U.S. 2008/0107463 extended those advantages from the previous invention, with all of the added benefits of the transparent coating obtained from gamma-alumina/poly(vinyl butyral), including higher resistivity and higher oil absorption. U.S. 2009/0052964 extends those advantages from the previous invention, with all of the added benefits of the transparent coating obtained from gamma-alumina/poly(vinyl butyral)/siloxane/fluorosurfactant, including higher resistivity and better cleaning of toner from the porous layer surface. This invention extends those advantages from previous invention, with all of the added benefits to an overcoat that tribocharges negatively against a negative charging toner to facilitate toner removal.

Siloxane polymers are useful to increase the resistivity of the gamma-alumina/poly(vinyl butyral) oil absorbing layer, and also act as lubricants that make cleaning of the layer more efficient. In general low molecular weight PDMS will make the layer substantially more resistive, to the point where it is similar to the PET substrate. For example, 10 micron coatings have been prepared with surface resistivities between $10^{13}$ and $10^{15}$ ohm/sq at 70° F./60% RH. This results in an important advantage of good paper or receiver tack down, even after several minutes of machine stoppage. The stable electrical properties of the gamma-alumina with the poly(vinyl butyral) binder and PDMS is depicted in FIG. 2 of US 2008/0107463. It is most preferable to have coated transport webs made with gamma-alumina, poly(vinyl butyral), and PDMS that have resistivities with a minimum resistivity equal to or greater than $1\times10^{13}$ ohm/sq at 70° F./60% RH.

Calcining of the mixed silica/boehmite alumina SIRAL particles converts the hydrophilic boehmite into the porous gamma-alumina phase. The SIRAL particles that were calcined at 550° C. benefit from treatment with these same low molecular weight siloxanes as the gamma-aluminas of the porous layer. The purpose is the same, to render the particles less susceptible to humidity that would decrease the surface resistivity of the coating and thus decrease the receiver tack-down.

It is also possible to generate PDMS polymers in-situ by adding alkoxysilanes to the coating solution. The addition of dimethoxydimethylsilane (DMDMS) to the ethanol coating solution leads to the formation of siloxane segments in the coating that also increase the resistivity and improve the cleaning properties.

At low humidity the porous layer is dry and has high resistivity. This allows for easy charging of the transport web and results in good paper tack down and good image registration and process control from imaging on the transport web.

Fluorosurfactants are useful as cleaning aids for inclusion in the oil-absorbing layers, serving to facilitate the removal of toner particles from the surface of the coated substrate as described in U.S. Pat. No. 7,120,380 and U.S. Patent Publication Numbers 2006/0165974 and 2009/0052964. The addition of the fluorosurfactant ZONYL FSN, a water-soluble, ethoxylated nonionic fluorosurfactant, to the oil-absorbing layer enables the removal of toner particles that are not readily removed in the absence of the surfactant. The oil-absorbing layer includes the fluorosurfactant preferably in an amount of about 0.01 wt. % to about 15 wt. %, more preferably, about 0.02 wt. % to about 12 wt. %, of the total amount of inorganic particles and organic binder. The fluorosurfactant can also be added to the negatively charging overcoat to help facilitate cleaning and act as a lubricant for the cleaning blade. The level of the fluorosurfactant can be as high as 40 wt % of the overcoat. These high levels of fluorosurfactant diffuse through the entire coating, effectively greatly lowering the levels of fluorosurfactants that actually end up in the overcoat.

Like most surfactants that are intended for aqueous applications, ZONYL FSN consists of about half a hydrophobic tail and half a hydrophilic portion. The hydrophobic portion consists of a short fluorocarbon chain $C_nF_{2n+1}$. The hydrophilic portion consists of an ethylene glycol chain $(C_2H_4O)_m$. The pure material is a greasy, tan solid with a melting point of 30° C. that is typically at levels of 0.01 to 0.1% by weight when used as a surfactant coating aid. However in this invention the ZONYL FSN serves as a lubricant to assist the polyurethane blade in cleaning of the toner from the surface of the transport web. Optimal properties are obtained when the ZONYL FSN is added at 9 parts by weight to the gamma-alumina/poly(vinyl butyral) (90/10) parts by weight in the layer, when 6 parts by weight siloxane is included. This corresponds to 7.8 weight % ZONYL FSN in the porous layer. Alternatively, the ZONYL FSN can be overcoated onto the porous alumina layer.

Some of the previous inventions described the addition of the fluorosurfactant ZONYL FSN to aid in cleaning of toner from the transport web surface. However, ZONYL FSN is composed from ethylene glycol with a fluorocarbon, and when this surfactant is combined with pseudo-boehmite and poly(vinyl alcohol), the resistivity of the coating has been found to decrease especially at high humidity. This results in a number of undesirable properties such as poor tack down of the paper or receiver to the transport web because the conductive ZONYL FSN surfactant provides a pathway for the charge to dissipate. The charge was deliberately place on the web by the web charger in order to hold the receiver in place and allow for imaging with toner for process control purposes and an image with poor quality can result from the charge dissipation. Although the resistivity of the web also decreases when added to the gamma-alumina/PVB/siloxane porous layer, the loss of resistivity is not as great as with the pseudo-boehmite based materials.

WE waxes are fatty acid esters formed from long chain fatty acid and alcohols produced by NOF Corporation of Japan. They are high purity solids characterized by narrow melting ranges, low endothermic energy for melting, and high thermostability. The waxes that melt below 100° C. do not block the pores of the gamma-alumina. However the WE waxes are not useful for this invention. The siloxane coating on the gamma-alumina prevent wetting of the film surface with the higher surface energy WE waxes. Addition of the waxes to the alumina dispersion or coating the wax over the alumina in a separate layer resulted in poor coatings that are not suitable for the purposes of this invention. We found that overcoating layers that incorporated 10 wt % PDMS with WE waxes resulted in spotty coatings of wax.

It is particularly advantageous to add the siloxane to the coating solution before it is milled. This results in a uniform distribution of the siloxane and good coating quality. Silanol terminated PDMS appears to be particularly useful to prepare good coating, possibly because the silanol groups interact or even condense on the surface of the gamma-alumina. The level of PDMS can be relatively high, with concentrations greater than 10 wt % of the coating solid. But it is even more surprising that the pore volume of the coated layer as measured by oil uptake of fuser oil can increase when PDMS is added to the formulation. In contrast, the addition of fluorosurfactants such as ZONYL FSN causes the oil absorption volume to decrease. The PDMS also aids in cleaning of the coating of toner that is deposited during color and receiver registration as part of the electrophotographic process control.

Measurement of the surface resistivity of the porous layer gives a good indication of how well the coated transport webs will hold a charge. The surface resistivity can be measured using a Keithley electrometer. A 10 micron thick coating of the gamma-alumina/poly(vinyl butyral) over the PET transport web had surface resistivity in the $10^{12}$ ohm/sq range that did not change more than an order of magnitude between 20-60% RH. Thus these coatings are approximately two order of magnitude more resistive than comparable pseudo-boehmite/PVA oil absorbing layers. Coatings over the PET transport web made with the addition of the fluorosurfactant ZONYL FSN to gamma-alumina/poly(vinyl-butyral) became slightly less resistive. A coating with 6 parts ZONYL FSN had a surface resistivity at 60% RH of $1\times10^{12}$ ohm/sq and a coating with 12 parts ZONYL FSN had a surface resistivity of $6\times10^{11}$ ohm/sq. Nonetheless, these values are about a two order of magnitude higher than those same coating using pseudo-boehmite in place of the gamma-alumina.

The addition of fluorosurfactants such as ZONYL FSN to formulations of gamma-alumina does not cause as large a decrease in resistivity as observed with pseudo-boehmite. Although this is not fully understood, it probably is related to the lower water component of the gamma-alumina compared to the pseudo-boehmite. Additionally, the siloxane coatings on the alumina particles further helps to prevent water uptake of the coating, and mitigates the increase in conductivity that is observed with the pseudo-boehmite/ZONYL FSN coatings. FIG. 2 is a graph of the increase of surface resistivity with increasing level of fluorosurfactant ZONYL FSN when to a formulation of 90 parts gamma-alumina/10 parts PVB/6 parts PDMS. The surface resistivity is greater than $10^{13}$ ohm/sq for ZONYL FSN levels up to 12 parts (10 wt %) of the porous overcoat. The coated transport webs readily cleaned. The surface resistivity decreased logarithmically in this region of ZONYL FSN concentration, but did not fall below $10^{13}$ ohm/sq. The optimum cleaning was obtained in Example 3, where the coated transport web with 9 parts (7.83 wt %) of ZONYL FSN had a surface resistivity of $6\times10^{13}$ ohm/sq.

These values are not as high in resistivity as obtained when first coating the gamma-alumina with PDMS. As reported in the previous application, addition of up to 10 wt % of silanol terminated poly(dimethylsiloxane) further increases the resistivity of the film into the $10^{14}$ ohm/sq range. In fact, these films are such good insulators that the resistivity readings are comparable to those obtained for PET, and are probably approaching the limit of the range measurable with the Keithley electrometer. Receiver tack-down to the gamma-alumina/PDMS coated web was almost as good as with the uncoated PET web, which corresponds to the high resistivity value for these materials. We now find that addition of ZONYL FSN to the gamma-alumina/poly(vinyl butyral)/siloxane improves toner removal from the surface of the film without seriously lowering the resistivity of the coating. These coatings have surface resistivities greater than $5\times10^{12}$ ohm/sq, and in most cases in the $10^{13}$ and $10^{14}$ ohm/sq range for loadings of up to 12 parts ZONYL FSN. The fluorosurfactants are compatible with the other components of the coating and can be added directly to the coating solution in 3A alcohol.

Siloxanes are also useful as overcoats for the oil absorbing layer if the fluorosurfactant is not present in the coating. They provide another layer of protection against moisture that might lower the resistivity at high relative humidity, and they help facilitate cleaning of toner by the cleaning blade. The siloxanes lower the surface energy of the alumina layer and act as lubricants. The siloxane overcoats do not interfere with oil absorption, nor do they cause image artifacts on prints from the electrophotographic printers. They can be coated from a number of environmentally acceptable solvents. We have shown previously that ethanol can be used to form an overcoat of low molecular weight silanol terminated PDMS, viscosity of 20-35 centistokes. Higher molecular weight PDMS of 10,000 centistoke and without hydroxyl groups can be prepared from 2-butanone. Surface resistivities as high as $10^{15}$ ohm/sq at 60% RH have been obtained in the films with high amounts of PDMS. However, attempts to use 100,000 centistoke PDMS resulted in slippage of the transport web in the printer, probably due to transfer of the PDMS to the back surface when the web was rolled upon itself. An inherent disadvantage to using an overcoat is an additional coating step is required that makes the coating process more complex and adds to the expense. However an overcoat allows a layer to be specifically designed for properties such as wear and cleaning of the webs, as long as the overcoat is transparent and porous enough to allow the release oil to pass through to the oil absorbing alumina layers below. Unfortunately coating solutions of PDMS tend to fowl the coating machine for subsequent coatings. The PDMS can change the properties of the surfaces of the coating rollers and cause undesirable coating artifacts in the next set of coatings. Cleaning siloxanes used in the overcoat from the coating rollers of a coating machine after the job is complete can require lengthy, difficult washing procedures with organic solvents that can make preparing such films prohibitively expensive. Siloxanes are liquids that spread readily on contact to other surfaces due to the low surface energy. They are notoriously difficult to contain.

Overcoats of fluorosurfactants have many of the same advantages as siloxane overcoats without the disadvantage of contamination of surrounding surfaces. In contrast to the liquid nature of the PDMS materials, fluorosurfactants tend to be waxy solids. They do not fowl the coating machine when coated as a separate layer, and are easier to clean from the coating roller due to the solubility in aqueous alcohols instead to organic solvents as for the siloxanes. They also do not flow to cover all surfaces due to the solid nature of the alkeneoxy-fluorocarbon. We have found that the addition of fluorosurfactant to siloxane coated gamma-alumina particles in a PVB binder resulted in improved cleaning of the porous layer without severe degradation of the resistivity. Because the fluorocarbon is more surface active than the siloxane, the material migrates to the top of the coating during drying. This further assists in the cleaning of the film by removing toner that is placed on the film for process control and color registration during electrophotographic printing.

Optionally, the fluorocarbon can be overcoated from an appropriate solvent such as aqueous alcohol to more completely cover the surface of the coating. Good results have been obtained by diluting the ZONYL FSN with either alcohol or water. This has several advantages including the use of less fluorocarbon in the base layers of the alumina, as the fluorocarbon is placed only where it is needed. This uses less fluorosurfactant which has both environmental and economic advantages. Further the oil absorption of the film is generally higher if the alumina pores are not filled with excess fluorosurfactant throughout the layers. Lower levels of fluorosurfactant also result in higher resistivity of the porous coating. Another option is to coat a thin overcoat of alumina, siloxane, binder and the fluorocarbon at a higher level than what is in the base coat. For example a layer containing as much as 30% of the fluorosurfactant can be used as a top layer of the coated web. Thus the top layer can serve as a reservoir of the fluorocarbon, leaving the lower layers free to hold more release oil.

While lubricants such as the fluorosurfactants help to facilitate cleaning of the porous layer, the amount of lubricant can be reduced with an overcoat of negatively charging oxide when using a negatively charging toner in the electrophotographic process. Reducing the level of fluorosurfactant necessary to facilitate cleaning has two beneficial effects. First, the fluorosurfactant lowers the resistivity of the porous layer because it generally contains hydrophilic portions such as poly(ethylene oxide). Second, the fluorosurfactant is generally present at high levels approaching 10 wt % of the porous coating, and will reduce the release oil uptake by occupying pore space in the layer. Release oil saturation is reached at lower print counts and the life of the transport web is shortened by a corresponding amount when high levels of fluorosurfactant are added to the porous alumina layer.

When printing duplex images on certain described reproduction apparatus, release oil that had been applied to an imaged receiver transfers to the transport web from sheets that are to be printed on the second side. Comparison measurements of oil concentrations as a function of duplex run lengths have been carried out on standard uncoated paper transport webs and on webs provided with an oil-absorbing layer in accordance with the present invention. The oil-absorbing coating provides protection from release oil artifacts by drawing release oil into the porous interior of the coating, reducing the amount of release oil available at the surface for transfer to other parts of the machine. On the basis of this mechanism, the useful life of a web would depend on the oil capacity of the coating, which would be expected to depend on the coating thickness. The effective lifetime of a coating can be predicted based on its estimated capacity and the measured oil take up rate. A gamma-alumina/poly(vinyl butyral)/PDMS/fluorosurfactant transport web of this invention provided protection against oil streaks on image flat field after almost 30,000 A4 equivalent prints. The web was still functioning when it was removed. Previous experiments with pseudo-boehmite showed the experiment could have continued much longer. An uncoated web shows the fuser oil stripe signature after 18 prints.

In conclusion, important properties of the negatively tribocharging layer of inorganic oxide coated over an oil-absorbing layer that would charge positively upon contact with negatively charge toner particles, such as gamma-alumina/poly(vinyl butyral)/siloxane/fluorosurfactant transport webs, include:

High resistivity to prevent charge from bleeding from the surface and decreasing the tackdown force of the receiver to the web (>$5\times10^{12}$ ohms/sq).

High porosity for the absorption of the fuser fluid release oil from the receiver to prevent the fluid from spreading to other components and causing image artifacts (200 to 600 mg/m$^2$/μm).

Good mechanical properties that produce long life coatings with no powder or dusting due to the good mechanical properties of the inorganic oxides in the polymer binder.

Improved registration of a composite image by the elimination of slippage of the intermediate transport drum against the transport web.

Good surface properties that allow for easy removal of negatively charging toner deposited during electrophotogaphic registration onto the negatively tribo-charging overcoat.

Ease of manufacturability because fluororsurfactants do not contaminate the coating machine that is used to apply the waxy solid.

The present invention is further illustrated by the following examples, but it should be understood that the invention is not in any way restricted to such examples.

EXAMPLES

Gamma-alumina powder and mixed silica-alumina powders were obtained from Sasol North America, Inc of Houston, Tex. under the trade names CATALOX 18HTa-150 alumina and SIRAL, respectively. The CATALOX 18HTa-150 had a surface area or 150 m$^2$/g and a pore volume of 0.446 cc/g. AEROSIL Fumed Silicas were obtained from Evonik Degussa Corporation of Parsippany, N.J.

A general procedure for the coating formulation of the porous oil-absorbing layer is described here. The gamma-alumina was roll milled in 3A-alcohol at 20% solids for 5 days using 2 micron zirconia or 1.8 micron yttria doped zirconia beads. The beads were filtered off using a stainless steel screen and the alumina dispersion filtered using a 40 micron PALL filter. The poly(vinyl butyral) binder and silanol terminated poly(dimethylsiloxane) was added to the dispersion before placing it through a Netzsch LabStar LS1 superfine grinding mill employing 1.0 micron yttria doped zirconia beads as the grinding material. Typically 1 liter of solution at 14% solids was milled for 1 hour. Additional binder or siloxane was sometimes added, and the dispersion filtered through a 10 micron PALL filter. The silanol terminated poly(dimethylsiloxane) was DMS-S12, molecular weight from 400-700, viscosity 16-32 centistoke, from Gelest, Inc., Tullytown, Pa., USA. Poly(vinyl butyral) was BH-6 ($9.2\times10^4$ molecular weight; 69+/−3 mole % butyral content) was obtained from Sekisui Products LLC, Troy, Mich.

The white gamma-alumina dispersion was coated, using an extrusion hopper, over a subbing layer of acrylonitrile-vinyl chloride-acrylic acid on one side of a 102 μm-thick polyethylene terephthalate (PET) film and dried at temperatures up to 105° C. for 20-30 minutes. The coatings were flexible, clear, transparent films that were formed into loops by ultrasonic sealing using with the coating on the outside of the loop.

The overcoat was prepared and coated in much the same manner and did not change the appearance of the coatings.

Comparative Example 1

A NexPress transport web made of 4 mil PET.

Comparative Examples 2

General Alumina Dispersion: 90 Parts Gamma-Alumina/10 Parts poly(vinyl butyral) Binder/6 Parts Silanol Terminated PDMS Gamma-alumina (400 g), 3 A alcohol (1000 g), and 2.0 mm zirconia beads (5000 g) were placed in a 1 gallon jar and roll milled for 48 hours at 90 RPM. The alumina was collected by filtering off the shot and rinsing with 3A-alcohol (1400 g) to give a 14.3% solids dispersion that was filtered though a 40 micron PALL filter to give a total of 2800 g. Ten batches of alumina dispersion were prepared in this way. A 22 L 3 neck round bottom flask fitted with a mechanical stirrer was then charged with 13,910 g of alumina dispersion. Poly(vinyl butyral) BH-6 (2150 g of a 10 wt % solution in 3A-alcohol) was added with an addition funnel to give a formulation with 10 wt % poly(vinyl butyral). Silanol-terminated PDMS, DMS-S12 (132.6 g), was added at 6% by weight of the total alumina and BH-6 solids to give a dispersion of 13.7% solids. The dispersion was Netzsch milled for 25 minutes for each liter of solution for a total of 453 minutes, followed by filtration through a 10 micron PALL filter.

The dispersion was web coated as described above with an aim thickness of 7.5 microns.

Comparative Examples 3

9 Parts ZONYL FSN (14.45 g@ 40% active) by weight of the total alumina and BH-6 was added to a stirred dispersion of the above General Alumina Dispersion of Comparative Example 2 (444 g).

The dispersion was web coated as described above with an aim thickness of 7.5 microns.

Comparative Example 4

Gamma-alumina (95 g), AEROSIL R 972 (5 g), 3A-alcohol (350 g), and 2.0 mm zirconia beads (1250 g) were placed in a 1 L jar and roll milled for 48 hours at 90 RPM. The alumina was collected by filtering off the shot and rinsing with 3A-alcohol (350 g) to give a 14.3% solids dispersion that was filtered though a 40 micron PALL filter to give a total of 700 g. A 3 L 3 neck round bottom flask fitted with a mechanical stirrer was then charged with 674 g of alumina/R 972 dispersion. Poly(vinyl butyral) BH-6 (107.1 g of a 10 wt % solution in 3A-alcohol) was added with an addition funnel to give a formulation with 10 wt % poly(vinyl butyral). Silanol-terminated PDMS, DMS-S12 (6.43 g), was added at 6% by weight of the total alumina and BH-6 solids to give a dispersion of 13.7% solids. The dispersion was Netzsch milled for 20 minutes, followed by filtration through a 10 micron PALL filter. Part of this dispersion (486 g), was stirred while additions were made of 3 A-alcohol (64.2), and 9 parts ZONYL FSN (16.9 g@ 40% active) by weight of the solids.

The dispersion was web coated as described above with an aim thickness of 7.5 microns.

Comparative Example 5

Gamma-alumina (95 g), AEROSIL RY 200 (5 g), 3A-alcohol (350 g), and 2.0 mm zirconia beads (1250 g) were placed in a 1 L jar and roll milled for 48 hours at 90 RPM. The alumina was collected by filtering off the shot and rinsing with 3A-alcohol (350 g) to give a 14.3% solids dispersion that was filtered though a 40 micron PALL filter to give a total of 700 g. A 3 L 3 neck round bottom flask fitted with a mechanical stirrer was then charged with 686 g of alumina/RY 200 dispersion. Poly(vinyl butyral) BH-6 (109.0 g of a 10 wt % solution in 3A-alcohol) was added with an addition funnel to give a formulation with 10 wt % poly(vinyl butyral). Silanol-terminated PDMS, DMS-S12 (6.54 g), was added at 6% by weight of the total alumina and BH-6 solids to give a dispersion of 13.7% solids. The dispersion was Netzsch milled for 20 minutes, followed by filtration through a 10 micron PALL filter. Part of this dispersion (581 g), was stirred while additions were made of 3 A-alcohol (61.6), and 9 parts ZONYL FSN (19.8 g@ 40% active) by weight of the solids.

The dispersion was web coated as described above with an aim thickness of 7.5 microns.

Comparative Example 6

Gamma-alumina (95 g), AEROSIL 130 (5 g), 3A-alcohol (350 g), and 2.0 mm zirconia beads (1250 g) were placed in a 1 L jar and roll milled for 48 hours at 90 RPM. The alumina was collected by filtering off the shot and rinsing with 3A-alcohol (350 g) to give a 14.3% solids dispersion that was filtered though a 40 micron PALL filter to give a total of 700 g. A 3 L 3 neck round bottom flask fitted with a mechanical stirrer was then charged with 677 g of alumina/AEROSIL 130 dispersion. Poly(vinyl butyral) BH-6 (107.6 g of a 10 wt % solution in 3A-alcohol) was added with an addition funnel to give a formulation with 10 wt % poly(vinyl butyral). Silanol-terminated PDMS, DMS-S12 (6.45 g), was added at 6% by weight of the total alumina and BH-6 solids to give a dispersion of 13.7% solids. The dispersion was Netzsch milled for 20 minutes, followed by filtration through a 10 micron PALL filter. Part of this dispersion (726 g), was stirred while additions were made of 3 A-alcohol (63.4), and 9 parts ZONYL FSN (24.2 g@ 40% active) by weight of the solids.

The dispersion was web coated as described above with an aim thickness of 7.5 microns.

Example 1

AEROSIL RY 200 (13.5 g), poly(vinyl butyral) BH-6 (1.5 g), and 3A-alcohol (485 g) were placed in a 1 L jar and roll milled for 48 hours at 90 RPM.

A base layer of the dispersion from Comparative Example 2 was coated at 7.5 microns on PET, and overcoated with the Example 1 dispersion with an aim thickness of 0.5 microns.

Example 2

A base layer of the dispersion from Comparative Example 3 was coated at 7.5 microns on PET, and overcoated with the Example 1 dispersion with an aim thickness of 0.5 microns.

Table 1 shows these films had good oil capacity and resistivity for a coated transport web. Coating thickness was determined by cross-sections using optical microscopy. Surface resistivity was measured using a Keithley 6517 Electrometer/High Resistance System and Keithley 8009 Resistance Test Fixture. The sample were kept at constant temperature and humidity overnight in a Tenney Six Chamber and each sample removed separately immediately before testing. The samples were approximately 7×7 cm squares. Oil absorbing was measured gravimetrically using 10×10 cm coatings on the PET. The sample weight was recorded to the fourth decimal point. An excess of NexPress fuser oil was placed on the sample using a stainless steel roller had been dipped into the oil. Care was taken not to get oil on the back of the sample. The samples generally become optically clear as the oil penetrates the coating. After 10 min, excess oil was removed from the sample using 3M High Performance Cloth 5208-W and the sample was weighed again. The difference in the weight is reported as the oil capacity.

Techniques for Determining the Tribocharging Properties of a Substrate Contacting Toner Contact or tribocharging can occur whenever two materials differing in position on the triboelectric scale contact one another. This can be especially problematic in electrophotographic print engines where toner particles contact another member as this can result in toner background on that member that can be transported and show up on another print.

The propensity for toner to tribocharge against another member can be determined as follows. The electric charge on the substrate, mounted to a grounded plate, is first measured. The substrate is then passed in close proximity to an operating development station containing the toner of interest. Any deposited toner is removed using compressed air and the potential on the substrate measured again. The difference between the post and pre development potential is the triboelectrically generated voltage.

In the examples described herein, the development station consisted of an electrically conducting cylindrical shell and a coaxial magnetic core. The shell was approximately 6 inches long and 2¼ A inches in diameter and was made from stainless steel. The shell was grounded. The magnetic core consisted of 20 magnets whose pole directions were radial to the core. Thus, the poles of the magnets were orthogonal to the long axis of the magnets.

Twelve grams of a commercial black developer containing black toner and magnetic carrier, used in a NexPress 2100 printer, was loaded onto the shell. The substrate was attached to a grounded aluminum platen and spaced approximately 15 mils above the shell of the development station. The platen was run at a speed of 2 in/s. The magnetic core was rotated at 405 rpm in a direction so that the developer would flow in the same direction as the platen. The speed of the shell was then set so that there would be no differential speed between the developer and the platen.

The potential on the substrate was initially measured using a Trek electrostatic voltmeter. The platen was then passed over the development station, any toner removed using compressed air, and the post development substrate potential once again measured.

The results in Table 1A and B show the Comparative Example 1, the PET web, did not absorb any oil. The uncoated web had a resistivity greater that 10E15 ohm/sq and tribocharged negatively against the negative charging toner. The toner was generally easily removed from the web.

Comparative Example 2 is the alumina layer without the fluorosurfactant. The 6 micron layer has good release oil absorption approaching 4 g per square meter, and good resistivity of 8×10E14 at the higher humidity. The coating charged strongly positive against the negative toner, around +100 V, and the toner was difficult to remove from the layer.

Comparative Example 3 had 9 parts ZONYL FSN added as a cleaning aid. It had lower oil absorption and lower resistivity than Comparative Example 2. The tribocharge results were much the same, showing the coating charged positive against the negative toner and was difficult to remove from the film.

Comparative Examples 4, 5, and 6, where the alumina was replaced with 5 wt % of the silica behaved much the same way at Comparative Example 3. The oil absorption was lower, although the films were slightly thinner at under 5 microns. Surface resistivity at high humidity was not as good. The tribocharging results were much the same as the all alumina samples, showing positive tribocharge when the negatively charging toner was placed on against the surface. Comparative Example 5 gave one set of data where the charge was negative with the negative toner and the toner was removed easily from the surface, but this could not be reproduced. The effect is believed to be due to contamination on the surface during that one measurement.

Example 1 and 2 both show opposite charging and cleaning behavior. Both samples tribocharged negatively with the negative toner. The toner was easily removed in both cases. Example 2 has 9 parts ZONYL FSN in the alumina base layer, which causes the lower oil absorption and resistivity, in much the same way as observed for Comparative Examples 2 and 3.

TABLE 1A

Characterization of Oil Absorbing Layers

| Example | Thickness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) | Visual Toner Amounts |
|---|---|---|---|---|---|---|---|---|---|
| Comparative 1 | 0 | 0 | >E+15 | >E+15 | Right | −002 | −028 | −26 | Low/ Medium |
| | | | | | Center | −011 | −042 | −31 | |
| | | | | | Left | 018 | −043 | −61 | |
| | | | | | Right | −061 | −055 | 6 | Low |
| | | | | | Center | −006 | −048 | −42 | |
| | | | | | Left | −013 | −058 | −45 | |
| | | | | | Right | −021 | −056 | −35 | Low |
| | | | | | Center | −140 | −104 | 36 | |
| | | | | | Left | −063 | −082 | −19 | |
| Comparative 2 | 5.68 | 3880 | 1.35E+16 | 7.88E+14 | Right | 014 | 092 | 78 | High |
| | | | | | Center | 016 | 117 | 101 | |
| | | | | | Left | 026 | 140 | 114 | |
| | | | | | Right | 005 | 087 | 82 | High |
| | | | | | Center | 026 | 140 | 114 | |
| | | | | | Left | 005 | 123 | 118 | |
| | | | | | Right | 017 | 099 | 82 | High |
| | | | | | Center | 035 | 134 | 99 | |
| | | | | | Left | 048 | 157 | 109 | |
| Comparative 3 | 5.93 | 2780 | 1.09E+15 | 1.10E+14 | Right | −032 | 065 | 97 | High |
| | | | | | Center | −029 | 092 | 121 | |
| | | | | | Left | −019 | 021 | 40 | |
| | | | | | Right | 094 | 159 | 65 | High |
| | | | | | Center | 016 | 135 | 119 | |
| | | | | | Left | 034 | 172 | 138 | |
| | | | | | Right | 015 | 093 | 78 | High |
| | | | | | Center | 027 | 117 | 90 | |
| | | | | | Left | 012 | 118 | 106 | |
| Comparative 4 | 4.87 | 1680 | 7.68E+12 | 3.06E+13 | Right | 017 | 107 | 90 | High |
| | | | | | Center | 008 | 124 | 116 | |
| | | | | | Left | 004 | 133 | 129 | |
| | | | | | Right | 008 | 108 | 100 | High |
| | | | | | Center | 003 | 120 | 117 | |
| | | | | | Left | 005 | 149 | 144 | |
| | | | | | Right | 058 | 132 | 74 | High |
| | | | | | Center | 082 | 147 | 65 | |
| | | | | | Left | 045 | 158 | 113 | |

TABLE 1B

Characterization of Oil Absorbing Layers

| Example | Thickness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) | Visual Toner Amounts |
|---|---|---|---|---|---|---|---|---|---|
| Comparative 5 | 4.87 | 1650 | 4.52E+13 | 6.08E+13 | Right | −021 | −052 | −31 | Low |
| | | | | | Center | −030 | −075 | −45 | |
| | | | | | Left | −018 | −068 | −50 | |
| | | | | | Right | 064 | 153 | 89 | High |
| | | | | | Center | 146 | 164 | 18 | |
| | | | | | Left | 018 | 153 | 135 | |
| | | | | | Right | 026 | 121 | 95 | High |
| | | | | | Center | 016 | 134 | 118 | |
| | | | | | Left | 017 | 208 | 191 | |

TABLE 1B-continued

| Characterization of Oil Absorbing Layers | | | | | | | | | |
|---|---|---|---|---|---|---|---|---|---|
| Example | Thick-ness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) | Visual Toner Amounts |
| Comparative 6 | 4.87 | 1600 | 4.93E+13 | 7.83E+13 | Right | −015 | 071 | 86 | High |
| | | | | | Center | −009 | 097 | 106 | |
| | | | | | Left | −011 | 120 | 131 | |
| | | | | | Right | −006 | 090 | 96 | High |
| | | | | | Center | 013 | 125 | 112 | |
| | | | | | Left | 029 | 143 | 114 | |
| | | | | | Right | 021 | 097 | 76 | High |
| | | | | | Center | 018 | 125 | 107 | |
| | | | | | Left | 017 | 138 | 121 | |
| Example 1 | 6.49 | 2680 | 4.37E+16 | 1.05E+15 | Right | 007 | −038 | −45 | Low |
| | | | | | Center | −018 | −048 | −30 | |
| | | | | | Left | −018 | −076 | −58 | |
| | | | | | Right | 001 | −032 | −33 | Low |
| | | | | | Center | −024 | −069 | −45 | |
| | | | | | Left | −008 | −062 | −54 | |
| | | | | | Right | −030 | −064 | −34 | Low |
| | | | | | Center | −037 | −072 | −35 | |
| | | | | | Left | −016 | −066 | −50 | |
| Example 2 | 6.49 | 1990 | 4.87E+14 | 6.92E+13 | Right | 013 | −019 | −32 | Low |
| | | | | | Center | −008 | −043 | −35 | |
| | | | | | Left | 031 | −036 | −67 | |
| | | | | | Right | −016 | −049 | −33 | Low |
| | | | | | Center | −023 | −080 | −57 | |
| | | | | | Left | −023 | −081 | −58 | |
| | | | | | Right | −024 | −057 | −33 | Low |
| | | | | | Center | −012 | −064 | −52 | |
| | | | | | Left | −033 | −084 | −51 | |

Table 2 shows that the oil absorbing web with silica in the overcoat and charge negatively also are readily cleaned of toner by the two urethane cleaning blades in the NexPress Color Printer. Examples 1 and 2 cleaned well under all conditions. All the patches were removed with the web conditioning charger on and when the web conditioning charger was off. Cleaning with the web conditioning charger off is a stress condition but the cleaning was good nonetheless. The test was repeated for both Examples 1 and 2 with the conditioning charger off and the webs were cleaned of toner by the blades in all attempts.

Comparative Example 1 is the uncoated PET web and it cleaned in a similar manner to the silica overcoated oil absorbing web of Example 1 and 2. However Comparative Example 1 has no oil absorption capacity and oil artifacts form in the prints after 20 duplex prints. Comparative Example 2 is the oil absorbing layer without the Zonyl FSN fluorosurfactant and it could not be run in the electrophotographic process without leaving high levels of toner on the web under all conditions. Comparative Example 3 is a standard transport web with an oil absorbing layer and it cleaned well as long as the web conditioning charger was engaged. A larger amount of toner was left on the web when the web conditioning charger was shut off.

Comparative Examples 4, 5, and 6 all gave results similar to the standard oil absorbing web Comparative Example 3. All of these webs contained the fluorosurfactant and showed good cleaning of the calibration patches with the web charger on. None of the webs were fully cleaned of the process control patches by the cleaning blades, and the amount of toner left on the webs increased when the web conditioning charger was shut off. These results indicate that having 5 wt % of silica mixed in with the alumina absorbing layer is not sufficient to change the tribocharge of the film surface to facilitate cleaning.

TABLE 2

| Full Process Cleaning of Oil Absorbing Webs in NexPress Printer | | | | |
|---|---|---|---|---|
| Example | Calibration Patches; Web Charger On | Process Patches; Web Charger On | Process Patches; Web Charger Off | Process Patches; Web Charger Off |
| Comp. 1 | YES | YES | YES | YES |
| Comp. 2 | Could not be tested | | | |
| Comp. 3 | YES | NO | NO | |
| Comp. 4 | YES | NO | NO | |
| Comp. 5 | YES | NO | NO | |
| Comp. 6 | YES | NO | NO | |
| Example 1 | YES | YES | YES | YES |
| Example 2 | YES | YES | YES | YES |

Comparative Example 7-9 and Example 3-10

Dispersions for Comparative Examples 7-9 were prepared as described for Comparative Example 3 using the quantities in Table 3. These were alumina solutions with either 9 wt % (Comparative Examples 7 and 9 dispersions) or 40 wt (Comparative Example 8 dispersion) ZONYL FSN added to the dispersion. Dispersions for Examples 3-10 were prepared as described for Example 1 using the quantities in Table 3.

TABLE 3

| Example | Comparative Example 2 (g) | RY 200L2 (g) | R972 (g) | BH-6 (g) | ZONYL FSN (g) | 3A-alcohol (g) |
|---|---|---|---|---|---|---|
| Comp 7 | 400 | | | | 12.3 | |
| Comp 8 | 30.0 | | | | 0.90 | 175.5 |
| Comp 9 | 30.0 | | | | 4.11 | 175.5 |
| Ex 3 | | 3.6 | | 0.4 | 4.11 | 196 |
| Ex 4 | | 3.4 | | 0.6 | 4.11 | 196 |
| Ex 5 | | 3.2 | | 0.8 | 4.11 | 196 |
| Ex 6 | | | 3.6 | 0.4 | 4.11 | 196 |
| Ex 7 | | | 3.4 | 0.6 | 4.11 | 196 |
| Ex 8 | | | 3.2 | 0.8 | 4.11 | 196 |
| Ex 9 | | 3.6 | | 0.4 | 2.50 | 196 |
| Ex 10 | | 3.6 | | 0.4 | 0.90 | 196 |

The alumina dispersion for Comparative Example 7 was coated on subbed PET support as described previously. This is a single layer coating that contains 9% ZONYL FSN, and is thus a repeat of Comparative Example 3. It serves as a control for this set of experiments.

The alumina dispersion described in Comparative Example 2 was used as a base coating for all of the other samples. The alumina dispersion from Comparative Example 2 did not contain ZONYL FSN and was coated at the same thickness as Comparative Example 2 on subbed PET.

The alumina dispersions for Comparative Examples 8 and 9 and the Aerosil dispersions for Examples 3-10 were coated at 0.5 microns dry thickness over the coating from alumina base layer from the dispersion described in Comparative Example 2. Comparative Examples 8 and 9 consisted of alumina overcoats that contained 40 and 9 wt % ZONYL FSN, respectively.

Characterization of these coating are described in Table 4. All of the coatings had good oil absorption and high resistivity. The tribocharge results show that all of the coatings with alumina on the surface tribocharge positively against the negative charging toner which remained on the film in large amounts. These are Comparative Examples 7-9. In contrast, the samples with silica overcoats charged negatively against the negative charging toner and the toner was more easily removed from the oil absorbing layer. These are Examples 3-10.

TABLE 4A

Characterization of Oil Absorbing Layers

| Example | Thickness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) | Visual Toner Amounts |
|---|---|---|---|---|---|---|---|---|---|
| Comparative 7 | 5.68 | 2540 | 1.45E+15 | 1.92E+13 | Right | −024 | 080 | 104 | High |
| | | | | | Center | −019 | 095 | 114 | |
| | | | | | Left | −020 | 118 | 138 | |
| | | | | | Right | −012 | 086 | 98 | High |
| | | | | | Center | 002 | 115 | 113 | |
| | | | | | Left | −010 | 126 | 136 | |
| | | | | | Right | −039 | 071 | 110 | High |
| | | | | | Center | −031 | 107 | 138 | |
| | | | | | Left | −047 | 107 | 154 | |
| Comparative 8 | 6.49 | 3470 | 9.17E+16 | 5.68E+14 | Right | −016 | 076 | 92 | High |
| | | | | | Center | 005 | 119 | 114 | |
| | | | | | Left | −017 | 137 | 154 | |
| | | | | | Right | −033 | 048 | 81 | High |
| | | | | | Center | −011 | 104 | 115 | |
| | | | | | Left | 022 | 140 | 118 | |
| | | | | | Right | −005 | 089 | 94 | High |
| | | | | | Center | −013 | 094 | 107 | |
| | | | | | Left | −000 | 125 | 125 | |
| Comparative 9 | 6.49 | 3370 | 5.46E+16 | 1.92E+14 | Right | −003 | 070 | 73 | High |
| | | | | | Center | −005 | 107 | 112 | |
| | | | | | Left | −025 | 103 | 128 | |
| | | | | | Right | −004 | 083 | 87 | High |
| | | | | | Center | 005 | 098 | 93 | |
| | | | | | Left | 011 | 110 | 99 | |
| | | | | | Right | −022 | 064 | 86 | High |
| | | | | | Center | 006 | 116 | 110 | |
| | | | | | Left | −015 | 119 | 134 | |
| Example 3 | 6.76 | 2650 | 3.94E+16 | 4.18E+14 | Right | −023 | −057 | −34 | Low |
| | | | | | Center | −009 | −055 | −46 | |
| | | | | | Left | −017 | −057 | −40 | |
| | | | | | Right | 000 | −048 | −48 | Low |
| | | | | | Center | 004 | −058 | −62 | |
| | | | | | Left | −006 | −075 | −69 | |
| | | | | | Right | −032 | −105 | −73 | Low |
| | | | | | Center | −036 | −092 | −56 | |
| | | | | | Left | −039 | −098 | −59 | |

TABLE 4A-continued

| Characterization of Oil Absorbing Layers | | | | | | | | | |
|---|---|---|---|---|---|---|---|---|---|
| Example | Thick-ness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) | Visual Toner Amounts |
| Example 4 | 6.22 | 2530 | 2.87E+15 | 2.90E+14 | Right | −032 | −069 | −37 | Low |
| | | | | | Center | −012 | −059 | −47 | |
| | | | | | Left | −024 | −070 | −46 | |
| | | | | | Right | 069 | 012 | −57 | Medium |
| | | | | | Center | −031 | −078 | −47 | Big Spot in center |
| | | | | | Left | −030 | −084 | −54 | |
| | | | | | Right | −016 | −063 | −47 | Low |
| | | | | | Center | −021 | −084 | −63 | |
| | | | | | Left | −021 | −097 | −76 | |

TABLE 4B

| Characterization of Oil Absorbing Layers | | | | | | | | | |
|---|---|---|---|---|---|---|---|---|---|
| Example | Thick-ness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) | Visual Toner Amounts |
| Example 5 | 6.49 | 2570 | 4.56E+16 | 3.38E+14 | Right | −024 | −060 | −36 | Low |
| | | | | | Center | −015 | −068 | −53 | |
| | | | | | Left | −014 | −067 | −53 | |
| | | | | | Right | −007 | −057 | −50 | Low |
| | | | | | Center | −010 | −071 | −61 | |
| | | | | | Left | −018 | −063 | −65 | |
| | | | | | Right | −031 | −081 | −50 | Low |
| | | | | | Center | −034 | −093 | −59 | |
| | | | | | Left | −024 | −095 | −71 | |
| Example 6 | 6.49 | 2850 | 1.60E+17 | 5.18E+14 | Right | −012 | −053 | −41 | Low |
| | | | | | Center | −018 | −062 | −44 | |
| | | | | | Left | −013 | −066 | −53 | |
| | | | | | Right | 007 | −036 | −43 | Low |
| | | | | | Center | −009 | −071 | −62 | |
| | | | | | Left | −005 | −076 | −71 | |
| | | | | | Right | −028 | −078 | −50 | Low |
| | | | | | Center | −038 | −094 | −56 | |
| | | | | | Left | −039 | −110 | −71 | |
| Example 7 | 6.76 | 2650 | 3.94E+16 | 4.18E+14 | Right | −016 | −057 | −41 | Medium |
| | | | | | Center | −013 | −071 | −58 | |
| | | | | | Left | −013 | −088 | −75 | |
| | | | | | Right | −063 | −102 | −39 | Low |
| | | | | | Center | −046 | −105 | −59 | |
| | | | | | Left | −032 | −099 | −67 | |
| | | | | | Right | −056 | −107 | −51 | Low |
| | | | | | Center | −044 | −096 | −52 | |
| | | | | | Left | −037 | −103 | −66 | |
| Example 8 | 6.22 | 2530 | 2.87E+15 | 2.90E+14 | Right | −018 | −057 | −39 | Low |
| | | | | | Center | −016 | −062 | −46 | |
| | | | | | Left | −022 | −065 | −43 | |
| | | | | | Right | −019 | −067 | −48 | Low |
| | | | | | Center | −002 | −055 | −53 | |
| | | | | | Left | −019 | −078 | −59 | |
| | | | | | Right | −037 | −065 | −48 | Low |
| | | | | | Center | −045 | −101 | −56 | |
| | | | | | Left | −031 | −088 | −57 | |
| Example 9 | 6.49 | 2570 | 4.56E+16 | 3.38E+14 | Right | −023 | −068 | −45 | Low |
| | | | | | Center | −006 | −065 | −59 | |
| | | | | | Left | −003 | −073 | −70 | |
| | | | | | Right | −034 | −079 | −45 | Low |
| | | | | | Center | −030 | −085 | −55 | |
| | | | | | Left | −032 | −091 | −59 | |
| | | | | | Right | −020 | −074 | −54 | Low |
| | | | | | Center | −026 | −086 | −60 | |
| | | | | | Left | −023 | −089 | −66 | |

TABLE 4C

Characterization of Oil Absorbing Layers

| Example | Thickness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) | Visual Toner Amounts |
|---|---|---|---|---|---|---|---|---|---|
| Example 10 | 6.49 | 2850 | 1.60E+17 | 5.18E+14 | Right | −015 | −058 | −43 | Low |
| | | | | | Center | −005 | −057 | −52 | |
| | | | | | Left | 045 | −040 | −85 | |
| | | | | | Right | 003 | −049 | −52 | Low |
| | | | | | Center | −014 | −077 | −63 | |
| | | | | | Left | −009 | −077 | −68 | |
| | | | | | Right | −030 | −072 | −42 | Low |
| | | | | | Center | −030 | −089 | −59 | |
| | | | | | Left | −026 | −093 | −67 | |

Comparative Example 10-12 and Examples 11 and 12

SIRAL Mixed Alumina-Silica Particles

SIRAL oxides are silica-alumina particles contain $SiO_2$ and $Al_2O_3$ in various combinations, where the number after the name represents the amount of silica. The alumina was in the boehmite phase in the samples provided by Sasol. The particles were calcined at 550° C. to convert the boehmite into the gamma-alumina phase.

Comparative Example 10 was made with CATALOX 18HTa-150 alumina. Comparative Examples 11 and 12 were made with SIRAL-1 and 10, respectively. Example 11 and 12 were made with SIRAL-30 and 40, respectively. The dispersions were prepared as described for the dispersion of Comparative Example 3. The amounts are given in Table 5.

TABLE 5

Milling of alumina and mixed alumina-silica oxides.

| Jar Number | Comparative 10 | Comparative 11 | Comparative 12 | Example 11 | Example 12 |
|---|---|---|---|---|---|
| 2.0 Zirconia Beads (g) | 625 | 625 | 625 | 625 | 625 |
| 3A-alcohol (g) | 100 | 100 | 100 | 100 | 100 |
| CATALOX (g) | 40 | | | | |
| SIRAL 1 (g) | | 40 | | | |
| SIRAL 10 (g) | | | 40 | | |
| SIRAL 30 (g) | | | | 40 | |
| SIRAL 40 (g) | | | | | 40 |
| Total wt (g) | 140 | 140 | 140 | 140 | 140 |
| % solids milled at | 28.57% | 28.57% | 28.57% | 28.57% | 28.57% |
| rinse 3A-alcohol (g) | 175 | 175 | 175 | 175 | 175 |
| Total after rinse solvent | 315 | 315 | 315 | 315 | 315 |
| aim % solids | 12.70% | 12.70% | 12.70% | 12.70% | 12.70% |

Roll milled the gamma alumina in 3A-alcohol with the zirconia beads for 72 h at 90 RPM. After the oxides were roll milled, the zirconia beads were washed with 3A-alcohol. The dispersions were formulated into coating "solutions" using the quantities in Table 6.

TABLE 6

Formulation of Coating Fluids from of alumina and mixed alumina-silica oxides.

| | Comparative 10 | Comparative 11 | Comparative 12 | Example 11 | Example 12 |
|---|---|---|---|---|---|
| Dispersion (g) | 290.0 | 291.0 | 305.0 | 271.00 | 272.0 |

TABLE 6-continued

Formulation of Coating Fluids from of alumina and mixed alumina-silica oxides.

| | Comparative 10 | Comparative 11 | Comparative 12 | Example 11 | Example 12 |
|---|---|---|---|---|---|
| BH-6 in 3A-alcohol | 40.92 | 41.06 | 43.04 | 38.24 | 38.38 |
| DMS-S12 (g) | 2.46 | 2.46 | 2.58 | 2.29 | 2.30 |
| ZONYL FSN @40% | 10.10 | 10.13 | 10.62 | 9.43 | 9.47 |

The dispersion was stirred as the components were added dropwise. The final product was filtered through a 10 micron Meissner DFA filter. The solutions were coated on subbed PET with an aim of 5 microns thickness.

Characterization of these coating are described in Table 7. All of the coatings had good oil absorption and high resistivity. The tribocharge results show that all of the coatings with alumina and less than 10% silica tribocharge positively against the negative charging toner. These are Comparative Examples 10-12. In contrast, the samples with higher amount of silica charged negatively against the negative charging toner. These are Examples 11 and 12.

TABLE 7

Characterization of SIRAL Oil Absorbing Layers

| Example | Thickness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) |
|---|---|---|---|---|---|---|---|---|
| Comparative 10 | 3.99 | 1300 | 2.62E+15 | 1.60E+14 | Right | 006 | 097 | 91 |
| | | | | | Center | −007 | 091 | 98 |
| | | | | | Left | 004 | 148 | 144 |
| Comparative 11 | 5.11 | 1590 | 1.14E+16 | 2.20E+14 | Right | 030 | 065 | 35 |
| | | | | | Center | 008 | 066 | 58 |
| | | | | | Left | 003 | 064 | 61 |
| Comparative 12 | 6.20 | 3080 | 2.08E+16 | 1.08E+15 | Right | 011 | 077 | 66 |
| | | | | | Center | 018 | 091 | 73 |
| | | | | | Left | −012 | 070 | 82 |
| Example 11 | 6.60 | 3600 | 8.58E+16 | 2.68E+15 | Right | 013 | 017 | 4 |
| | | | | | Center | 003 | 002 | −1 |
| | | | | | Left | −004 | −004 | 0 |
| Example 12 | 3.38 | 3630 | 9.78E+16 | 2.75E+15 | Right | −006 | −015 | −9 |
| | | | | | Center | −002 | −025 | −23 |
| | | | | | Left | −002 | −026 | −24 |

Comparative Example 13 and Example 13

A stock dispersion of alumina was prepared in a Union Process S-10, 60 L ceramic lined attritor filled with 100 kg of 2 micron alumina milling media. The attritor was charged with 3A-alcohol (12,250 g) and DMS-S12 silanol (166.7 g) and then the slow addition of Catalox 18HTa-150 alumina (5000 g). After 16 h of milling, the white dispersion was drained and the media rinsed with 3A-alcohol (19750 g) to produce a stock dispersion of 14% solids.

A dispersion of alumina for the base coating prepared from the stock alumina dispersion (800 g) was placed in 3 neck round bottom flask with a mechanical stirrer and a 10% solution of BH-6 in 3A-alcohol (123.30 g), DMS-S12 (3.43 g), ZONYL FSN @ 40% active (2.37 g) were added dropwise. The dispersion was Netzsch milled and filtered with a 10 micron Meissner DFI filter. The base coat for contained 0.7 parts ZONYL FSN.

The overcoat dispersion was prepared using the water soluble binder of poly(vinyl alcohol) instead of poly(vinyl butyral) in alcohol. A 10 wt. % poly(vinyl alcohol) solution was prepared in a ratio of 10 g poly(vinyl alcohol) powder (AH-26 GOHSENOL, Nippon Gohsei) to 90 g stirred deionized water, and heating the mixture to 80° C. for 1 hour to produce a clear, viscous solution. Aerosiol 200 was added to the solution of AH-26 PVA to give a dispersion of 10 wt % binder with the silica. The solution was diluted to 4 wt % total solids by the addition of water.

Comparative Example 13 was a coating of the alumina dispersion on PET, and Example 13 was an overcoated film of the alumina with the silica/PVA dispersion.

The results in Table 8 show that the alumunia oil absorbing layer remains porous after overcoating with a silica/PVA binder. Comparative Example 13 of the alumina layer yields a positive tribocharge value and the silica overcoated sample of Example 13 yields a negative tribocharge value against the negatively charging toner.

The invention has been described in detail with particular reference to certain preferred embodiments thereof, but it will be understood that variations and modifications can be effected within the spirit and scope of the invention.

The invention claimed is:

1. An electrostatographic reproduction apparatus comprising:

a primary imaging member for producing an electrostatic latent image;

a development station for applying toner particles to said latent image, thereby forming a developed toner image;

a transfer station for transferring said developed toner image from the primary imaging member to a receiver;

a fuser assembly for fixing said developed toner image to said receiver, thereby forming a fused toner image on said receiver;

an endless transport member for transporting said receiver to or from said fuser assembly, said transport member comprising a substrate bearing an oil-absorbing porous layer that would tribocharge positively upon contact with negatively charged toner particles, and a porous

TABLE 8

Characterization of Aerosil overcoat in PVA binder.

| Example | Thickness (μ) | Oil Capacity (mg/m$^2$) | Surface Resistivity (ohm/sq) (75° F./ 27% RH) | Surface Resistivity (ohm/sq) (70° F./ 60% RH) | Location across film | Initial (Vo) | Final (Vo) | Tribo (delta V) |
|---|---|---|---|---|---|---|---|---|
| Comparative 13 | NA | 2950 | 5.00E+17 | 9.57E+14 | Right | −020 | 053 | 73 |
| | | | | | Center | −021 | 068 | 89 |
| | | | | | Left | −002 | 077 | 79 |
| Example 13 | 3.80 | 2580 | 1.05E+16 | 2.09E+14 | Right | −015 | −104 | −89 |
| | | | | | Center | −010 | −109 | −99 |
| | | | | | Left | −010 | −128 | −118 |

overcoat outermost layer that does not tribocharge positively upon contact with negatively charged toner particles;

wherein the porous overcoat outermost layer comprises silica particles and a binder of polyvinyl alcohol or polyvinyl butyral in a weight ratio of from about 5:1 to about 20:1; and has a dried thickness of 0.25 to 10 micrometers that allows for silicone oil absorption with a value of 200 to 600 $mg/m^2/\mu m$,

2. The electrostatographic reproduction apparatus of claim 1, wherein the oil-absorbing porous layer comprises gamma-alumina particles having an average dispersed particle size of less than 0.5 microns dispersed in a polymeric binder.

3. The electrostatographic reproduction apparatus of claim 2, wherein said gamma-alumina particles have an average dispersed particle size of less than 0.3 microns.

4. The electrostatographic reproduction apparatus of claim 1, wherein the oil-absorbing porous layer is and porous overcoat outermost layer are transparent.

5. The electrostatographic reproduction apparatus of claim 1, wherein the oil-absorbing porous layer comprises ceramic particles dispersed in a polymer binder.

6. The electrostatographic reproduction apparatus of claim 1, wherein said oil-absorbing porous layer comprises gamma-alumina particles and poly(vinyl butyral) in a weight ratio of about 3:1 to about 20:1.

7. The electrostatographic reproduction apparatus of claim 1, wherein said substrate bearing an oil-absorbing porous layer is selected from the group consisting of a continuous web loop, a drum, and a roller.

8. The electrostatographic reproduction apparatus of claim 1, wherein the transport member has a resistivity equal to or greater than $5\times10^{12}$ ohm/sq at 70° F./60% RH.

9. The electrostatographic reproduction apparatus of claim 1, wherein said development station comprises a plurality of separate developing devices to enable full color image reproduction.

10. The electrostatographic reproduction apparatus of claim 1, wherein said reproduction apparatus is adapted for duplex printing.

11. The electrostatographic reproduction apparatus of claim 1, wherein said transport member comprises a polyethylene terephthalate substrate.

12. The electrostatographic reproduction apparatus of claim 1 wherein the porous overcoat outermost layer further comprises polydimethylsiloxane.

13. The electrostatographic reproduction apparatus of claim 1 wherein the overcoat further comprises a fluorosurfactant.

14. The electrostatographic reproduction apparatus of claim 13 wherein the fluorosurfactant is ZONYL FSN.

15. The electrostatographic reproduction apparatus of claim 13, wherein the transport member has a surface resistivity equal to or greater than $5\times10^{12}$ ohm/sq at 70° F./60% RH.

16. The electrostatographic reproduction apparatus of claim 1, further comprising an intermediate image transfer member operationally associated with the primary image-forming member for transferring the developed toner image from the primary imaging member to the receiver.

* * * * *